US009375937B2

(12) United States Patent
Sugahara

(10) Patent No.: US 9,375,937 B2
(45) Date of Patent: Jun. 28, 2016

(54) LIQUID EJECTING DEVICE HAVING CONVEYING MECHANISM FOR CONVEYING CARTRIDGE TO CARRIAGE

(71) Applicant: Brother Kogyo Kabushiki Kaisha, Nagoya-shi, Aichi-ken (JP)

(72) Inventor: Hiroto Sugahara, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/638,405

(22) Filed: Mar. 4, 2015

(65) Prior Publication Data

US 2015/0251468 A1 Sep. 10, 2015

(30) Foreign Application Priority Data

Mar. 7, 2014 (JP) ..... 2014-045393

(51) Int. Cl.
*B41J 2/175* (2006.01)
*B41J 29/38* (2006.01)

(52) U.S. Cl.
CPC ..... *B41J 2/1752* (2013.01); *B41J 2/17546* (2013.01); *B41J 29/38* (2013.01)

(58) Field of Classification Search
CPC .. B41J 2/1752; B41J 2/17543; B41J 2/17546; B41J 25/34; B41J 29/38
See application file for complete search history.

(56) References Cited

U.S. PATENT DOCUMENTS

2002/0015068 A1* 2/2002 Tsukada ..... B41J 29/38 347/19
2009/0315928 A1* 12/2009 Maruyama ..... B41J 2/17546 347/7
2011/0242209 A1* 10/2011 Yazawa ..... B41J 2/1752 347/37

FOREIGN PATENT DOCUMENTS

JP 2007-069541 A 3/2007

* cited by examiner

*Primary Examiner* — Geoffrey Mruk
*Assistant Examiner* — Scott A Richmond
(74) *Attorney, Agent, or Firm* — Banner & Witcoff, Ltd.

(57) ABSTRACT

A liquid ejecting device includes a casing, a carriage, a cartridge, an ejection unit, a conveying mechanism, an access unit, and a controller. The conveying mechanism is configured to convey the cartridge between a second position where the cartridge is mounted on the carriage and a third position where at least part of the cartridge is exposed outside the casing. The access unit is configured to access first storage to read cartridge information. The controller is configured to perform a first process to: control the access unit to read the cartridge information from the first storage; determine whether the cartridge information meets a prescribed condition; and control the conveying mechanism to convey the cartridge to the second position, if the cartridge information meets the prescribed condition.

16 Claims, 10 Drawing Sheets

LIQUID EJECTING DEVICE HAVING CONVEYING MECHANISM FOR CONVEYING CARTRIDGE TO CARRIAGE

CROSS REFERENCE TO RELATED APPLICATION

This application claims priority from Japanese Patent Application No. 2014-045393 filed Mar. 7, 2014. The entire content of this priority application is incorporated herein by reference.

TECHNICAL FIELD

The present invention relates to a liquid ejecting device on which a cartridge is mounted on a carriage.

BACKGROUND

In the related art, an on-carriage type liquid ejecting device having a carriage on which a recording head and an ink cartridge are mounted is well-known in the art. For example, the known liquid ejecting device includes an automatic mounting mechanism for mounting a cartridge on the carriage and a determination unit for determining whether the cartridge is mounted at an appropriate position in the carriage. If the cartridge is not mounted at the appropriate position, the automatic mounting mechanism repeatedly performs a cartridge mounting operation to mount the cartridge on the carriage until the cartridge is mounted at the appropriate position.

SUMMARY

However, in the liquid ejecting device, since the cartridge is mounted at a position on the carriage regardless of whether or not the position is the appropriate position, the following problems may occur. For example, a cartridge whose use-by date has already elapsed may be mounted on the carriage, causing a poor quality ink to be flowed into the recording head. For another example, if a plurality of cartridges accommodating inks having difference colors may be mounted on the carriage, the inks may be mixed with each other in the recording head. In addition, the cartridge mounting operation is repeatedly performed until the cartridge is mounted at the appropriate position, prolonging the time of the cartridge mounting operation.

In view of the foregoing, it is an object of the invention to provide a liquid ejecting device having a mechanism capable of mounting a cartridge at an appropriate position of a carriage.

In order to at least attain the above object, the invention provides a liquid ejecting device. The liquid ejecting device may include a casing, a carriage, a cartridge, an ejection unit, a conveying mechanism, an access unit, and a controller. The casing may be formed with an opening. The carriage may be configured to movable in a main-scanning direction in the casing and be positionable at a first position. The cartridge may include an accommodation chamber accommodating liquid therein and a first storage configured to store cartridge information. The cartridge may be configured to be removably mounted on the carriage through the opening when the cartridge is at the first position. The ejection unit may be configured to eject the liquid accommodated in the accommodation chamber. The ejection unit may be mounted on the carriage in a state where the cartridge is mounted on the carriage. The conveying mechanism may be configured to convey the cartridge between a second position and third position. The second position may be such a position that the carriage is mounted on the carriage and the liquid accommodated in the accommodation chamber is ejectable from the ejection unit. The third position may be such a position that at least a part of the cartridge is exposed and positioned outside the casing through the opening. The conveying mechanism may be positioned between the opening and the carriage positioned at the first position. The access unit may be configured to access the first storage to read the cartridge information and to be positionally overlapped with the first storage of the cartridge at a position different from the second position. The controller may be configured to perform a first process to: control the access unit to read the cartridge information from the first storage; determine whether the cartridge information meets a prescribed condition; and control the conveying mechanism to convey the cartridge to the second position, if the cartridge information meets the prescribed condition.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1A:
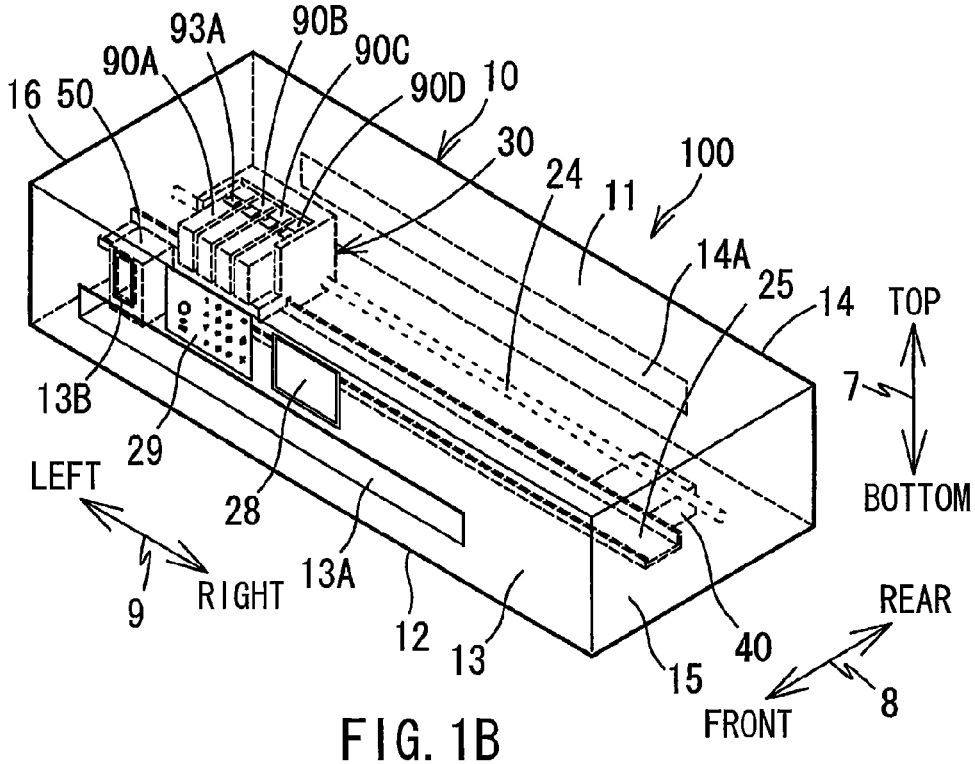
FIG. 1A is a front perspective view of an inkjet recording device according to an embodiment of the invention.

Next, a preferred embodiment of the present invention will be described. Note that the embodiment described below is merely an example of the invention and may be modified in many ways without departing from the spirit of the invention, the scope of which is defined by the attached claims. In the following description, an top-bottom direction 7 is defined for an inkjet recording device 100 when the inkjet recording device 100 is oriented in a usable state (the state in FIGS. 1A and 1B); a front-rear direction 8 is defined based on the side of the inkjet recording device 100 in which a discharge opening 13A is formed serving as the near side (front surface); and a left-right direction 9 is defined based on the perspective of a user facing the near side (front surface) of the inkjet recording device 100. Further, an upward direction and a downward direction are both components of the top-bottom direction 7; a forward direction and a rearward direction are both components of the front-rear direction 8; and a leftward direction and rightward direction are both components of the left-right direction 9.

[Inkjet Recording Device]

FIGS. 1A through 3 show the inkjet recording device 100 (an example of a liquid ejecting device) according to a preferred embodiment of the present invention. The inkjet recording device 100 includes a casing 10, a pair of conveying rollers 21, a pair of discharge rollers 22, a platen 23, a guide shaft 24, a guide rail 25, a carriage 30, a maintenance mechanism 40, a conveying mechanism 50, cartridges 90A to 90D, and a controller 130 (see FIG. 7). The inkjet recording device 100 records images on a recording sheet 5 (see FIG. 2) by ejecting ink accommodated in the cartridges 90A to 90D. Further, the inkjet recording device 100 is an on-carriage type inkjet printer in which the cartridges 90A to 90D are mounted on the carriage 30.

[Casing]

Figure 1B:
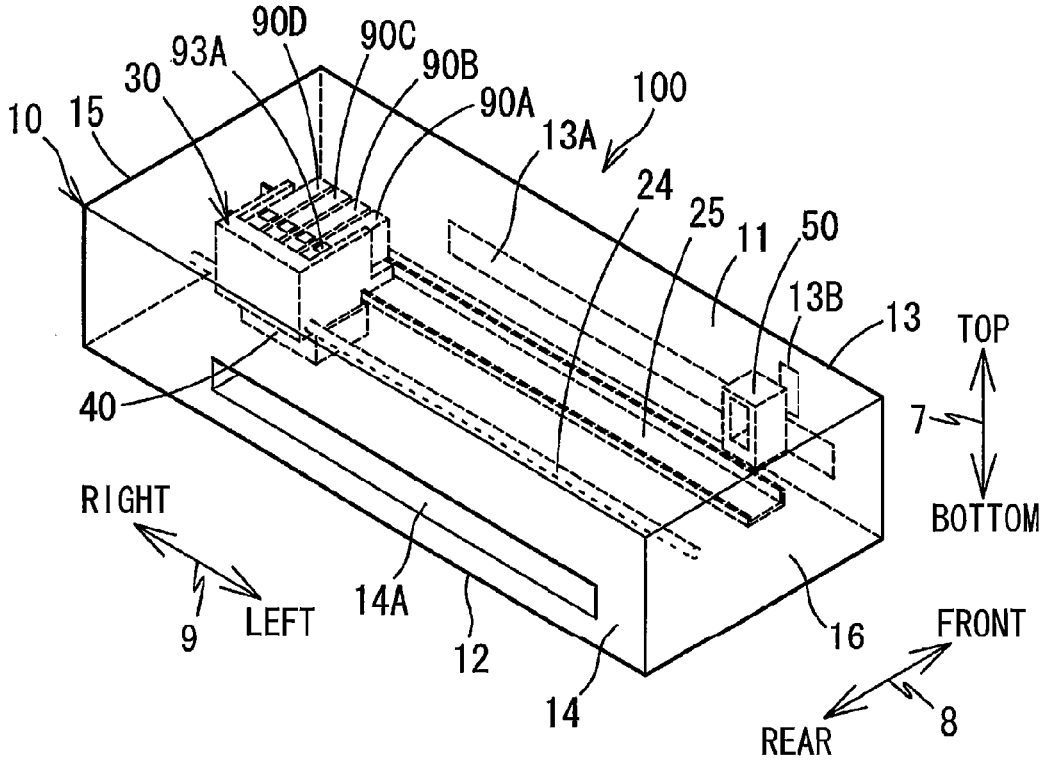
FIG. 1B is a rear perspective view of the inkjet recording device according to the embodiment of the invention.

As shown in FIGS. 1A and 1B, the casing 10 is box-shaped with space formed in the interior thereof. Within this internal space, the casing 10 supports the conveying rollers 21, the discharge rollers 22, the platen 23, the guide shaft 24, the guide rail 25, the carriage 30, the maintenance mechanism 40, the conveying mechanism 50, and the like. As shown in FIGS. 1A and 1B, the casing 10 has a general rectangular parallelepiped shape having a top wall 11, a bottom wall 12, a front wall 13, a rear wall 14, a right wall 15, and a left wall 16. At least part of the top wall 11 is positioned opposite to at least part of the bottom wall 12 in the top-bottom direction 7. That is, at least part of the top wall 11 is overlapped with at least part of the bottom wall 12 as viewed from the top-bottom direction 7. At least part of the front wall 13 is positioned opposite to at least part of the rear wall 14 in the front-rear direction 8. That is, at least part of the front wall 13 is overlapped with at least part of the rear wall 14 as viewed from the front-rear direction 8. At least part of the right wall 15 is positioned opposite to at least part of the left wall 16 in the left-right direction 9. That is, at least part of the right wall 15 is overlapped with at least part of the left wall 16 as viewed from the left-right direction 9.

The rear wall 14 is formed with the insertion opening 14A through which a recording sheet 5 is inserted into the casing 10 for an image to be recorded thereon. The front wall 13 is formed with the discharge opening 13A through which a recording sheet 5 is discharged from the casing 10 after an image has been recorded thereon, and an opening 13B through which cartridges 90A to 90D can pass. The opening 13B is formed at a position facing the conveying mechanism 50 in the front-rear direction 8. In addition, the front wall 13 is provided with a display unit 28 and an operation unit 29. The display unit 28 outputs (that is, displays) information to a user, and the operation unit 29 is input with information (for example, a replacement command described later) from the user. The display unit 28 and the operation unit 29 are examples of a user interface configured to receive information from a user and output information to the user. In addition, the front wall 13 is an example of an interface surface.

[Conveying Rollers and Discharge Rollers]

Figure 2:
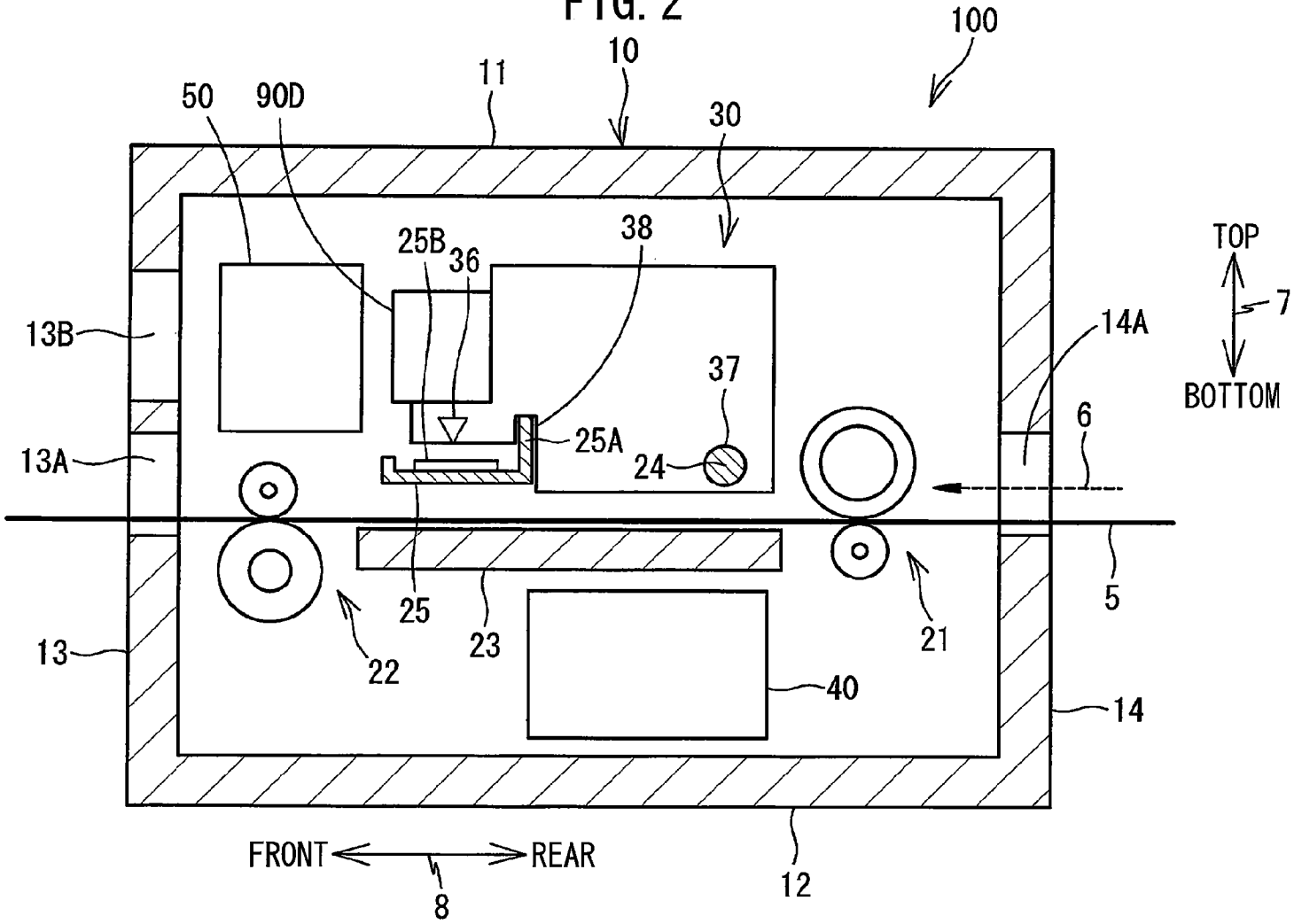
FIG. 2 is a vertical cross-sectional view of the inkjet recording device according to the embodiment of the invention.

As shown in FIG. 2, the conveying rollers 21 pinch the recording sheet 5 inserted into the casing 10 through the insertion opening 14A and convey the recording sheet 5 in a conveying direction 6 (i.e., direction from the rear side of the inkjet recording device 100 toward the front side in the preferred embodiment) so that the recording sheet 5 passes between the carriage 30 and the platen 23. The discharge rollers 22 grip the recording sheet 5 conveyed from the conveying rollers 21 and convey the recording sheet 5 in the conveying direction 6, discharging the recording sheet 5 from the casing 10 through the discharge opening 13A. The conveying rollers 21 are disposed upstream of the carriage 30 in the conveying direction 6, and the discharge rollers 22 are disposed downstream of the carriage 30 in the conveying direction 6. The conveying rollers 21 and the discharge rollers 22 are driven to rotate by a drive force transmitted from a conveying motor 101 (see FIG. 7).

[Platen]

As shown in FIG. 2, the platen 23 is disposed between the conveying rollers 21 and the discharge rollers 22 in the front-rear direction 8 and at a position facing the carriage 30 in the top-bottom direction 7. The platen 23 supports the recording sheet 5 from below as the recording sheet 5 is conveyed by the conveying rollers 21 and the discharge rollers 22.

[Guide Shaft and Guide Rail]

Figure 3:
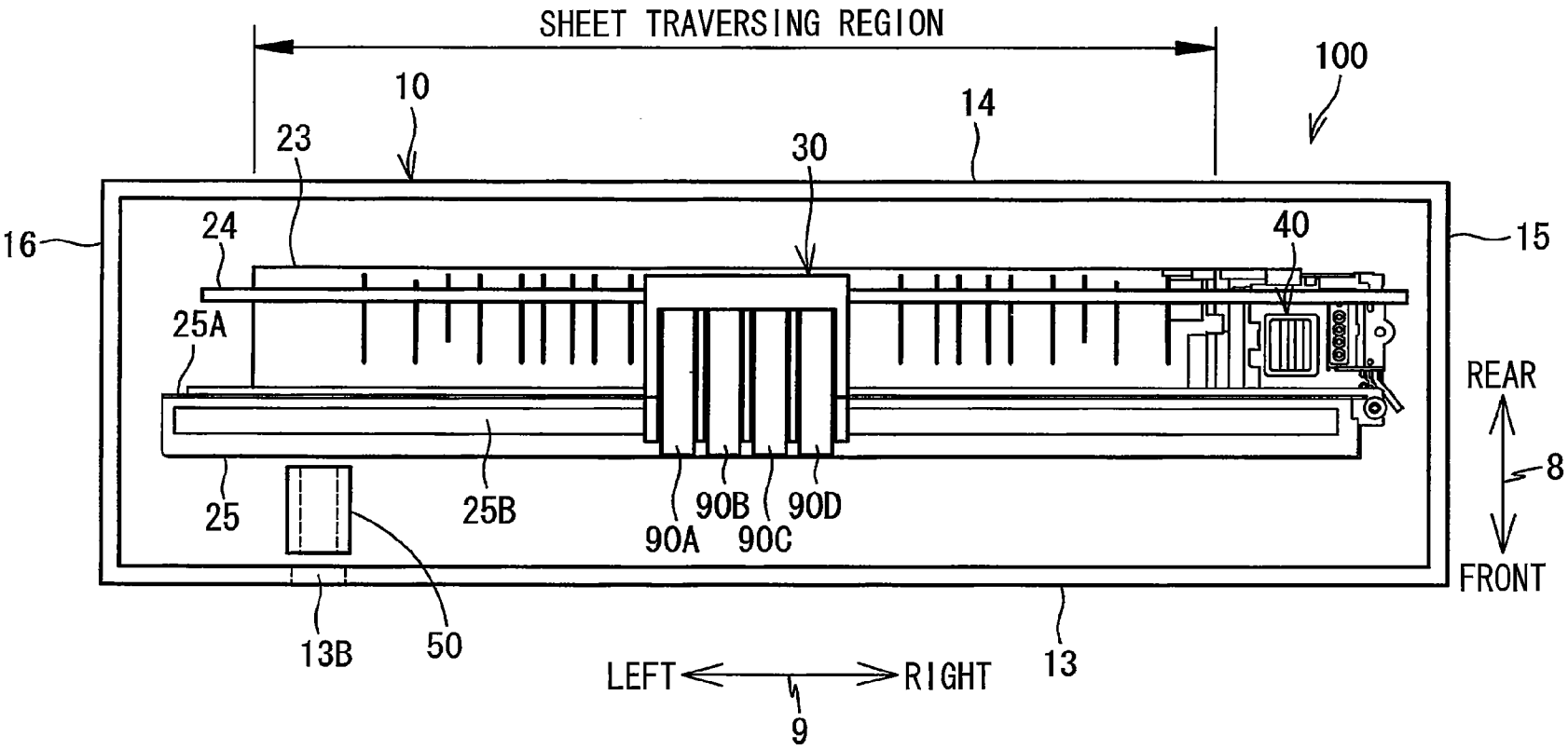
FIG. 3 is an internal plan view of the inkjet recording device according to the embodiment of the invention.

As shown in FIGS. 2 and 3, the guide shaft 24 and the guide rail 25 are elongated in the left-right direction 9 and separated from each other in the front-rear direction 8. The guide shaft 24 is inserted through an insertion opening 37 (described later) formed through the carriage 30 on the upstream side of the guide rail 25 in the conveying direction 6. The guide rail 25 supports part of the carriage 30 from below on the downstream side of the guide shaft 24 in the conveying direction 6. The guide rail 25 has a top surface provided with a protruding rib 25A fitted into a groove 38 (described later) formed in the carriage 30, and an encoder strip 25B elongated in the left-right direction 9.

[Carriage]

As shown in FIG. 2, the carriage 30 faces the platen 23 in the top-bottom direction 7 and is arranged between the conveying rollers 21 and the discharging rollers 22 in the front-rear direction 8. As shown in FIGS. 2, 3, 4A and 4B, the carriage 30 includes a recording head 31 (an example of an ejection unit), mounting units 32, 33, 34, and 35, a carriage sensor 36, the insertion opening 37, and the groove 38. As shown in FIG. 2, the guide shaft 24 is inserted into the insertion opening 37, and the protruding rib 25A is fitted into the groove 38, positioning the carriage 30 in the top-bottom direction 7 and the front-rear direction 8.

Figure 7:
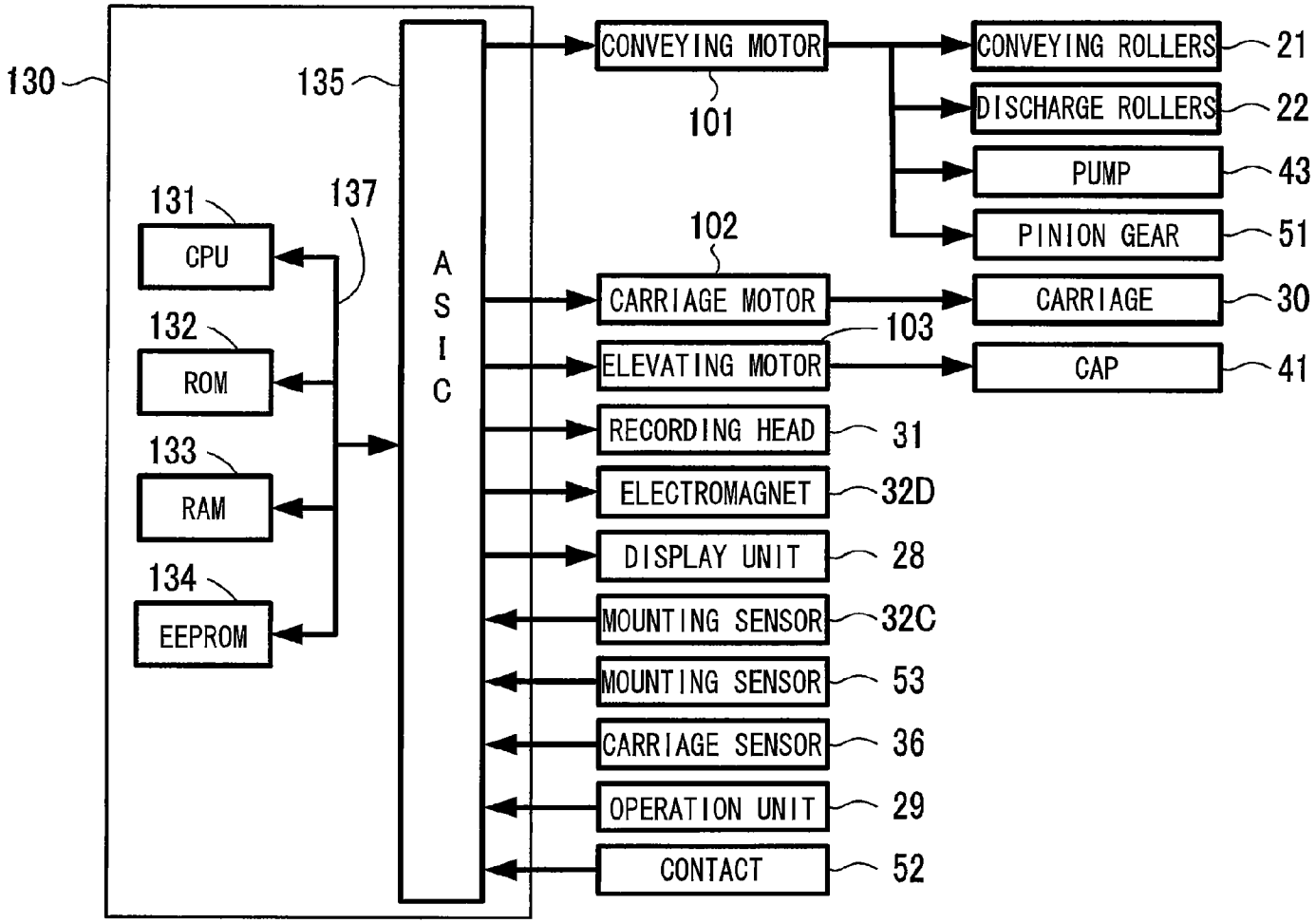
FIG. 7 is a block diagram of the inkjet recording device according to the embodiment of the invention.

The carriage 30 is moved in the left-right direction 9 (an example of a main-scanning direction) upon receiving a driving force from a carriage motor 102 (see FIG. 7). For example, as shown in FIG. 1A, the carriage 30 can be moved to a removable position (an example of a first position) where the carriage 30 faces the conveying mechanism 50 in the front-rear direction 8 and to a capping position (an example of a fourth position, see FIG. 1B) where the carriage 30 faces the maintenance mechanism 40 in the top-bottom direction 7. In addition, the removable position includes a first removable position (see FIG. 1A) where the cartridge 90A mounted on the mounting unit 32 faces the conveying mechanism 50 in the front-rear direction 8, a second removable position where the cartridge 90B mounted on the mounting unit 33 faces the conveying mechanism 50 in the front-rear direction 8, a third removable position where the cartridge 90C mounted on the mounting unit 34 faces the conveying mechanism 50 in the front-rear direction 8, and a fourth removable position where the cartridge 90D mounted on the mounting unit 35 faces the conveying mechanism 50 in the front-rear direction 8.

[Recording Head]

Figure 4A:
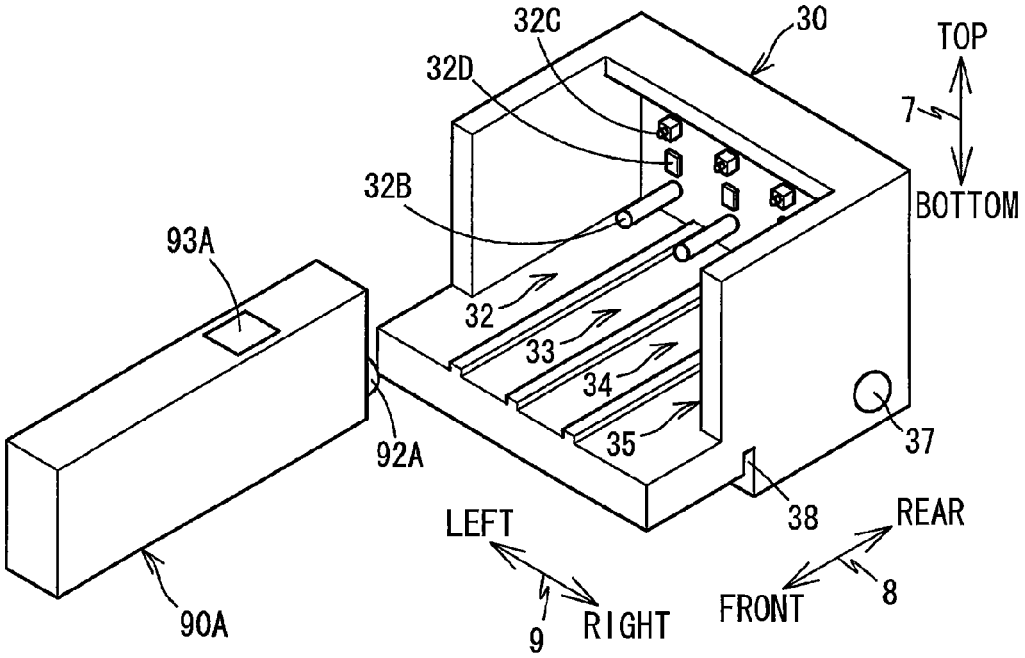
FIG. 4A is a top perspective view of a carriage wherein cartridges are not yet mounted on mounting units of the carriage according to the embodiment of the invention.
Figure 4B:
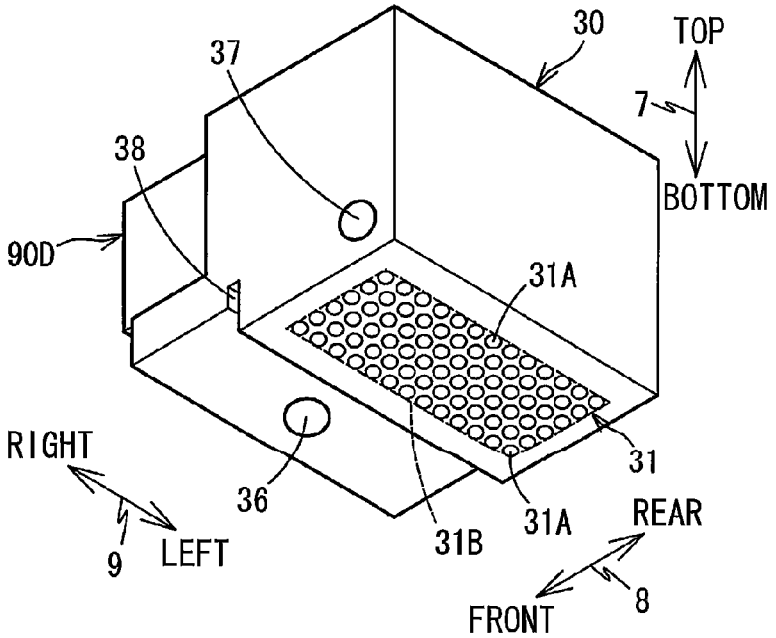
FIG. 4B is a bottom perspective view of the carriage wherein the cartridges are mounted on the mounting units according to the embodiment of the invention.

As shown in FIG. 4B, the recording head 31 is mounted on the carriage 30. As the carriage 30 moves over a sheet-traversing region shown in FIG. 3, the recording head 31 ejects ink onto the recording sheet 5 conveyed by the conveying rollers 21 and the discharging rollers 22, thereby recording an image on the recording sheet 5. The recording head 31 has a plurality of nozzles 31A configured to eject ink (as an example of liquid) accommodated in the cartridges 90A to 90D mounted on the mounting units 32 to 35, respectively. The nozzles 31A have tip ends exposed from the lower surface of the carriage 30. In addition, the carriage 30 has a nozzle surface 31B on which the tip ends of the nozzles 31A are exposed, as depicted by encircled dot-line in FIG. 4B. In the embodiment, the nozzle surface 31B extends generally in a horizontal plane.

[Mounting Units]

As shown in FIG. 4A, the mounting units 32 to 35 are provided in the carriage 30 to be adjacent to each other in the left-right direction 9. The respective cartridges 90A to 90D are configured to be mounted on and removed from the corresponding mounting units 32 to 35 in the front-rear direction 8. Since the mounting units 32 to 35 have substantially the same configuration, only the configuration of the mounting unit 32 will be described in detail. The mounting unit 32 has an inner surface provided with an ink needle 32B (an example of a liquid introducing portion), a mounting sensor 32C, and an electromagnet 32D.

The ink needle 32B protrudes forward from the inner surface of the mounting unit 32. The ink needle 32B enters an ink supplying portion 92A (described later) of the cartridge 90A mounted on the mounting unit 32, providing a fluid communication between the cartridge 90A and the recording head 31. The mounting sensor 32C is a contact-type sensor configured to output a mounting/non-mounting signal indicating whether or not the cartridge 90A is mounted on the mounting unit 32. If the cartridge 90A is mounted on the mounting unit 32, the mounting sensor 32C outputs a high level signal (as an example of a signal whose signal level is a threshold level or more). If the cartridge 90A is not mounted on the mounting unit 32, the mounting sensor 32C outputs a low level signal (as an example of a signal whose signal level is less than the threshold level). When the controller 130 supplies a first current to the electromagnet 32D (see FIGS. 6A to 6D), an attractive force is generated between the electromagnet 32D and a magnet 94A (described later) of the cartridge 90A. In addition, when the controller 130 supplies a second current opposite to the first current to the electromagnet 32D, a repulsive force is generated between the electromagnet 32D and the magnet 94A of the cartridge 90A. The electromagnet 32D and the magnet 94A are an example of an assisting unit.

[Cartridges]

As shown in FIGS. 1A and 1B, each of the cartridges 90A to 90D has a substantially rectangular-parallelepiped shape and defines a box-shaped space accommodating ink formed therein. In the embodiment, the cartridges 90A to 90D store inks having different colors of black, cyan, magenta, and yellow, respectively. Since the cartridges 90A to 90D have substantially the same configuration, only the configuration of the cartridge 90A will be described in detail. As shown in FIGS. 4A and 6A to 6D, the cartridge 90A includes an accommodation chamber 91A, the ink supplying portion 92A (an example of a liquid supplying portion), an IC chip 93A (an example of first storage), the magnet 94A, and a rack gear 95A.

The accommodation chamber 91A is configured to accommodate an ink therein. The ink supplying portion 92A is configured to supply the ink accommodated in the accommodation chamber 91A to the ink needle 32B entered into the ink supplying portion 92A. The IC chip 93A is configured to store various kinds of cartridge information. The cartridge information is information about the cartridge 90A. In addition, the IC chip 93A is rewritable storage, that is, cartridge information can be overwritten in the IC chip 93A. The controller 130 writes the cartridge information in the IC chip 93A and reads the cartridge information from the IC chip 93A through a contact 52 (descried later) of the conveying mechanism 50. The magnet 94A is provided at a position facing the electromagnet 32D in the front-rear direction 8 in a state where the cartridge 90A is mounted on the mounting unit 32. The rack gear 95A is engaged with a pinion gear 51 (described later) of the conveying mechanism 50.

[Carriage Sensor]

As shown in FIG. 2, the carriage sensor 36 is mounted on the bottom surface of the carriage 30 at a position facing the encoder strip 25B in the top-bottom direction 7. As the carriage 30 moves along the left-right direction 9, the carriage sensor 36 reads the encoder strip 25B, generates a pulse signal, and outputs this pulse signal to the controller 130. The carriage sensor 36 is configured to output the position signal (i.e., the pulse signal) for identifying the position of the carriage 30.

[Maintenance Mechanism]

Figure 5:
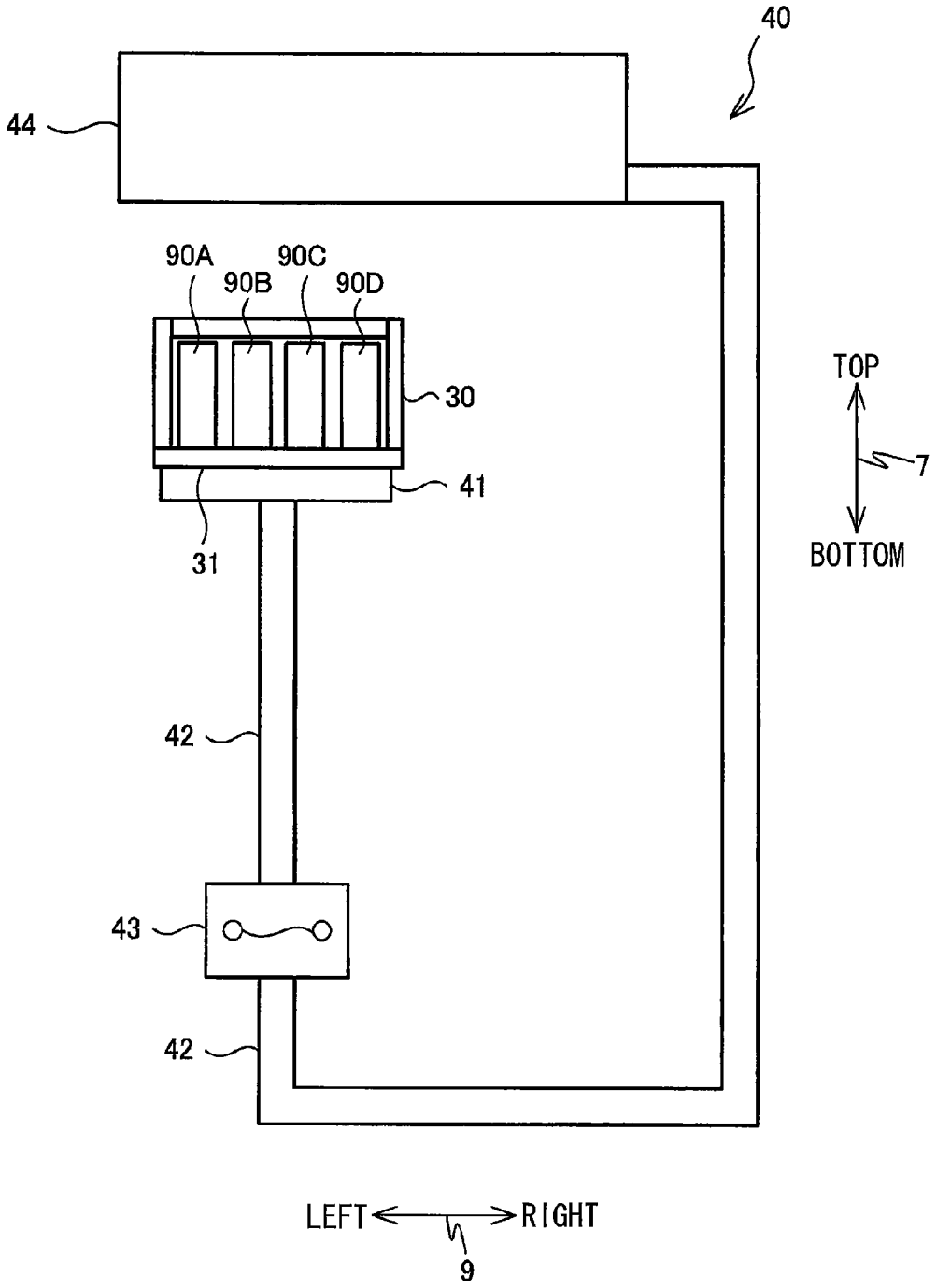
FIG. 5 is a schematic view of a maintenance mechanism according to the embodiment of the invention.

As shown in FIG. 3, the maintenance mechanism 40 is positioned outside the region in which the recording sheet 5 passes (denoted the "sheet-traversing region" in FIG. 3) in the left-right direction 9. More specifically, the maintenance mechanism 40 is disposed at a position facing the carriage 30 positioned at the capping position. The maintenance mechanism 40 is configured to execute a process to remove by suction air bubbles and foreign matter together with ink from the nozzles 31A formed in the recording head 31 (known as a purging operation). As shown in FIG. 5, the maintenance mechanism 40 includes a cap 41, a tube 42, a pump 43, and a waste liquid tank 44.

The cap 41 moves in the top-bottom direction 7 (i.e., rises and falls) relative to the carriage 30 when the carriage 30 is at the capping position by a drive force transmitted from an elevating motor 103 (see FIG. 7). More specifically, the cap 41 can be moved between a covering position (as an example of a fifth position) at which the cap 41 contacts the recording head 31 and liquid-tightly covers the nozzle surface 31B, and a separated position (as an example of a sixth position) at which the cap 41 is separated from the nozzle surface 31B of the recording head 31. The cap 41 is formed of rubber, for example. When at the covering position, the cap 41 hermetically contacts the peripheral portion of the nozzle surface 31B, hermetically sealing the cap 41 and the recording head 31 (i.e., nozzle surface 31B). At the separated position, the cap 41 is vertically separated from the recording head 31 with a gap therebetween.

The tube 42 has a first end connected to the cap 41 and a second end connected to the waste liquid tank 44. The pump 43 is provided at a midpoint along the tube 42. The pump 43 is a peristaltic tube pump, for example, and is configured to generate a flow of ink from the first end of the tube 42 toward the second end when a drive force is transmitted to the pump 43 from the conveying motor 101. Thus, when the pump 43 is driven while the cap 41 is at the covering position, ink is drawn out from the nozzles 31A through the tube 42 and is discharged into the waste liquid tank 44.

[Conveying Mechanism]

As shown in FIGS. 1A to 3, the conveying mechanism 50 is provided between the opening 13B and the carriage 30 positioned at the removable position in the front-rear direction 8. In other words, the conveying mechanism 50 faces the opening 13B and the carriage 30 positioned at the removable position in the front-rear direction 8. The conveying mechanism 50 is formed with a passage through which each of the cartridges 90A to 90D can pass in the front-rear direction 8. The conveying mechanism 50 conveys each of the cartridges 90A to 90D in the front-rear direction 8, allowing each of the cartridges 90A to 90D to be mounted on and removed from the carriage 30 at the removable position. As shown in FIGS. 6A to 6D, the conveying mechanism 50 includes the pinion gear 51, the contact 52 (an example of an access unit), and a mounting sensor 53 (see FIG. 7). Since the relationships between the conveying mechanism 50 and the cartridges 90A to 90D are substantially the same, only the relationship between the conveying mechanism 50 and the cartridge 90A will be described in detail.

The pinion gear 51 is configured to be rotated by a driving force transmitted from the conveying motor 101. More specifically, the pinion gear 51 engaged with the rack gear 95A is rotated in a first direction (clockwise direction in FIGS. 6A to 6D) where the cartridge 90A is conveyed from the opening 13B toward the carriage 30 in the front-rear direction 8 and in a second direction (counterclockwise direction in FIGS. 6A to 6D) where the cartridge 90A is conveyed from the carriage 30 toward the opening 13B in the front-rear direction 8. The contact 52 is configured to be in electrical contact with the IC chip 93A of the cartridge 90A, providing the electrical communication between the controller 130 and the IC chip 93A.

The mounting sensor 53 is configured to output a mounting/non-mounting signal indicating whether or not the cartridge 90A is mounted on the conveying mechanism 50. The mounting sensor 53 includes a light emitting element (not shown) provided at one of the right and left walls defining the passage through which the cartridge 90A passes and a light receiving element (not shown) provided at the other of the right and left walls. The mounting sensor 53 outputs the mounting/non-mounting signal according to whether or not light output from the light emitting element is received by the light receiving element. The light emitted from the light emitting element is blocked by the cartridge 90A when the cartridge 90A is mounted on the conveying mechanism 50. If the light is not received on the light receiving element, the mounting sensor 53 outputs a high level signal indicating that the cartridge 90A is mounted on the conveying mechanism 50 (as an example of a signal whose signal level is a threshold level or more). If the light is received by the light receiving element, the mounting sensor 53 outputs a low level signal indicating that the cartridge 90A is not mounted on the conveying mechanism 50 (as an example of a signal whose signal level is less than the threshold level).

Figure 6A:
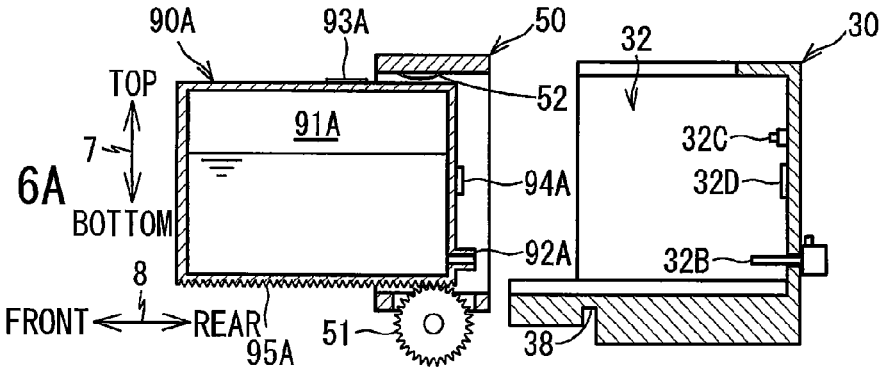
FIG. 6A is a cross-sectional view showing the carriage, the cartridge, and a conveying mechanism wherein the cartridge is positioned at a removal position according to the embodiment of the invention.
Figure 6B:
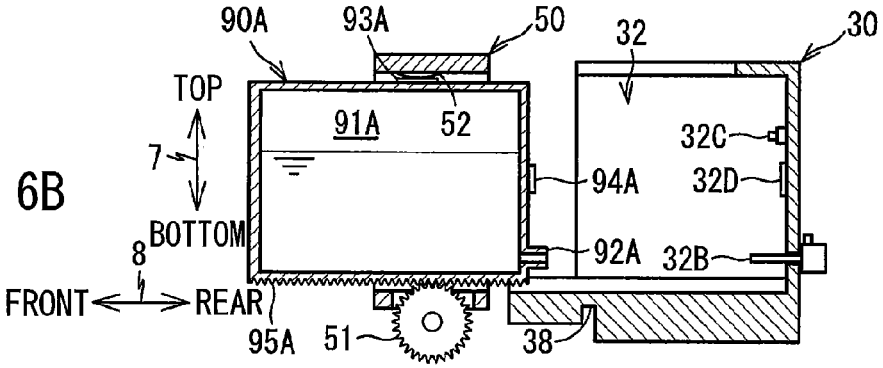
FIG. 6B is a cross-sectional view showing the carriage, the cartridge, and the conveying mechanism wherein the cartridge is positioned at an access position according to the embodiment of the invention.
Figure 6C:
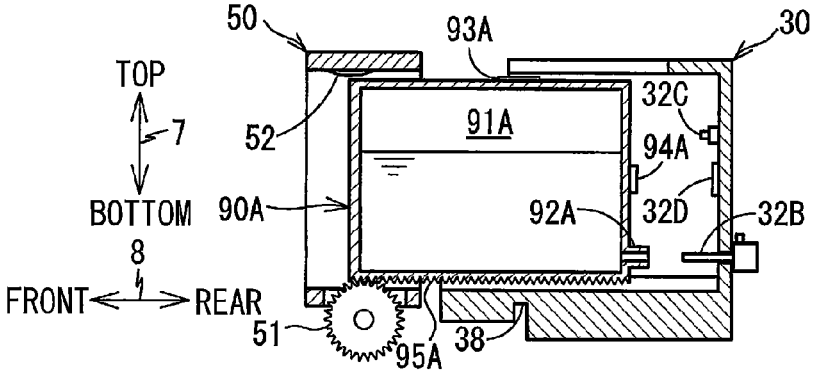
FIG. 6C is a cross-sectional view showing the carriage, the cartridge, and the conveying mechanism wherein the cartridge is positioned at an intermediate position according to the embodiment of the invention.
Figure 6D:
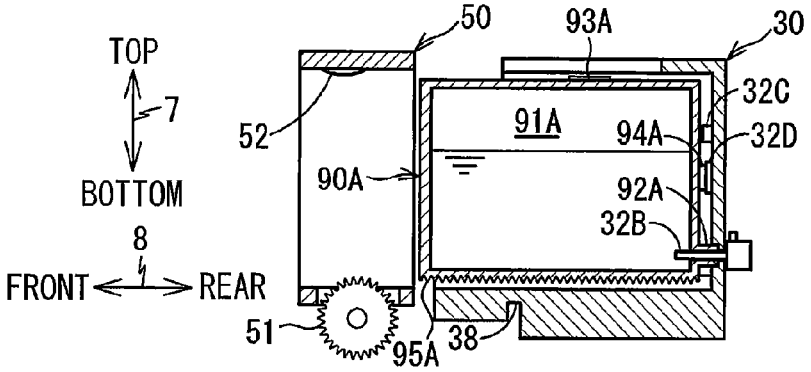
FIG. 6D is a cross-sectional view showing the carriage, the cartridge, and the conveying mechanism wherein the cartridge is positioned at a mounted position according to the embodiment of the invention.

The conveying mechanism 50 is configured to convey the cartridge 90A to a removal position (an example of a third position) shown in FIG. 6A, an access position shown in FIG. 6B, an intermediate position shown in FIG. 6C and a mounted position (an example of a second position) shown in FIG. 6D. More specifically, the conveying mechanism 50 rotates the pinion gear 51 in the first direction, conveying the cartridge 90A from the removal position to the mounted position through the access position and the intermediate position. At this time, the electromagnet 32D and the magnet 94A assist the displacement of the cartridge 90A from the intermediate position shown in FIG. 6C to the mounted position shown in FIG. 6D when the first current is supplied to the electromagnet 32D. In addition, the conveying mechanism 50 rotates the pinion gear 51 in the second direction, conveying the cartridge 90A from the mounted position to the removal position through the access position and the intermediate position. At this time, the electromagnet 32D and the magnet 94A assist the displacement of the cartridge 90A from the mounted position shown in FIG. 6D to the intermediate position shown in FIG. 6C when the second current is supplied to the electromagnet 32D.

The removal position is a position where at least part of the cartridge 90A (specifically, a portion opposite to the ink supplying portion 92A in the front-rear direction 8) is exposed and positioned outside of the casing 10 through the opening 13B. When the cartridge 90A is at the removal position, the pinion gear 51 is engaged with an end of the rack gear 95A (specifically, the end portion adjacent to the ink supplying portion 92A in the front-rear direction 8). The access position is a position where the IC chip 93A of the cartridge 90A and the contact 52 are in electrical contact with each other, i.e., vertically and positionally overlapped with each other. In the embodiment, the access position of the cartridge 90A is rearward of the removal position and forward of the mounted position. However, the access position is not limited to the example shown in FIG. 6B, but a position, for example, other than the mounted position may be employed. For instance, the access position may be the removal position. The intermediate position of the cartridge 90A is rearward of the access position and forward of the mounted position. The mounted position is the position where the cartridge 90A is mounted on the mounting unit 32, the position where the ink needle 32B enters the ink supplying portion 92A, and the position where the ink accommodated in the cartridge 90A is configured to be ejected from the recording head 31. The cartridge 90A at the mounted position is separated from the conveying mechanism 50 in the front-rear direction 8.

[Controller]

As shown in FIG. 7, the controller 130 includes a central processing unit 131 (CPU), a read only memory 132 (ROM), a random access memory 133 (RAM), an electrically erasable programmable read only memory 134 (EEPROM, an example of a second storage), and an application specific integrated circuit 135 (ASIC), which components are all interconnected by an internal bus 137. The ROM 132 stores a program and the like for controlling various processes performed by the CPU 131. The RAM 133 serves as a storage area for temporarily storing data, signals, and the like used by the CPU 131 in executing the above programs, or as a work area for data processing. The EEPROM 134 stores settings, flags, and the other data that must be preserved when the power supply is turned off. All or some of the CPU 131, the ROM 132, the RAM 133, the EEPROM 134, and the ASIC 135 may be configured on a single IC chip or may be divided in a plurality of IC chips.

The controller 130 is configured to drive the conveying motor 101 through a drive circuit in order to rotate the conveying rollers 21, the discharging rollers 22, and the pinion gear 51 and to drive the pump 43. The driving force of the conveying motor 101 is distributed to those components through a driving force transmission mechanism (not shown). The controller 130 is also configured to drive the elevating motor 103 through a drive circuit in order to raise and lower the cap 41. The controller 130 is also configured to drive the carriage motor 102 through a drive circuit in order to move the carriage 30 in the left-right direction 9.

In addition, the controller 130 is configured to control the recording head 31 to eject the ink from the nozzles 31A through the drive circuit. The controller 130 is configured to control the drive circuit to supply a current to the electromagnet 32D in order to produce a magnetic flux generating an attractive or repulsive force between the electromagnet 32D and the magnet 94A (increase or decrease a magnetic density). The electromagnets (not shown) provided in the other mounting units 33 to 35 have the same configuration. The controller 130 is configured to control the display unit 28 to display information through a display circuit.

In addition, the controller 130 is configured to determine the mounted state of the cartridge 90A to the mounting unit 32 and the conveying mechanism 50 based on the mounting/non-mounting signals output from the mounting sensors 32C and 53, respectively. For example, if the high level signal is output from the mounting sensor 32C, the controller 130 determines that the cartridge 90A is mounted on the mounting unit 32. Similarly, if the high level signal is output from the mounting sensor 53, the controller 130 determines that the cartridge 90A is mounted on the conveying mechanism 50. On the other hand, if the low level signal is output from the mounting sensor 32C, the controller 130 determines that the cartridge 90A is not mounted on the mounting unit 32. Similarly, if the low level signal is output from the mounting sensor 53, the controller 130 determines that the cartridge 90A is not mounted on the conveying mechanism 50. The same is true with respect to the mounting sensors (not shown) provided in the other mounting units 33 to 35.

The controller 130 is also configured to identify the position of the carriage 30 based on pulse signal output from the carriage sensor 36. For example, the controller 130 sets a count value to zero when the carriage 30 is at a reference position (for example, the capping position), incrementing the count value by the number of pulse signals received as the carriage 30 moves away from the reference position and decrementing the count value by the number of pulse signals received as the carriage 30 approaches the reference position. Hence, the count value corresponds to the distance between the current position of the carriage 30 and the reference position thereof.

The controller 130 is configured to receive information from the user through the operation unit 29. The controller 130 reads cartridge information from the IC chip 93A and writes cartridge information in the IC chip 93A through the contact 52. For example, the controller 130 reads from the IC chip 93A the cartridge information including type information, expiration information, viscosity information, ejection amount information, ink remaining amount information, or used-up information, or any combination thereof, each stored in the IC chip 93A, and writes in the IC chip 93A the ejection amount information, the ink remaining amount information, or the used-up information, or any combination thereof. The controller 130 is configured to write the various types of information read from the IC chip 93A of the cartridge 90A mounted on the mounting unit 32 in the EEPROM 134. The same is true with respect to the IC chips (not shown) of the other cartridges 90B to 90D.

The type information indicates the type (for example, color) of the ink accommodated in the cartridge 90A. The expiration information is used for identifying the use-by date of the cartridge 90A. The use-by date is a date set by the manufacturer of the cartridge 90A that indicates by when the cartridge 90A can be used. The expiration information may indicate the use-by date itself, or the production date of the cartridge 90A. In the latter case, the use-by date can be identified by adding a predetermined period of time to the production date. The viscosity information indicates the viscosity of the ink accommodated in the cartridge 90A. The viscosity information is not limited to specific information representing of the actual viscosity value. For example, the viscosity information may indicate whether the colorant of the ink is a pigment or a dye. The ejection amount information indicates an amount (hereinafter, referred to as "ejection amount") of the ink ejected from the cartridge 90A through the recording head 31. The ink remaining amount information indicates an ink remaining amount in the cartridge 90A estimated from the ejection amount. Since the ink remaining amount can be obtained by subtracting the ejection amount from the initial amount of the ink, the ejection amount is in one-to-one correspondence with the ink remaining amount. The used-up information indicates that the ink remaining amount in the cartridge 90A is less than a threshold remaining amount or indicates that the ejection amount of the cartridge 90A reaches a threshold ejection amount (as an example of a threshold value).

[Cartridge Mounting Process]

The cartridge mounting process will be described with reference to FIGS. 8 to 9B. Hereinafter, an example will be described in which the cartridges 90A and 90B are to be removed from the mounting units 32 and 33 and the cartridges 90A and 90B are to be mounted on the mounting units 32 and 33. It is assumed that the cartridge 90A stores a black ink whose colorant is a pigment and the cartridge 90B stores a cyan ink whose colorant is a dye. In addition, it is assumed that the viscosity of the black ink having the pigment is higher than that of the cyan ink having the dye.

Figure 8:
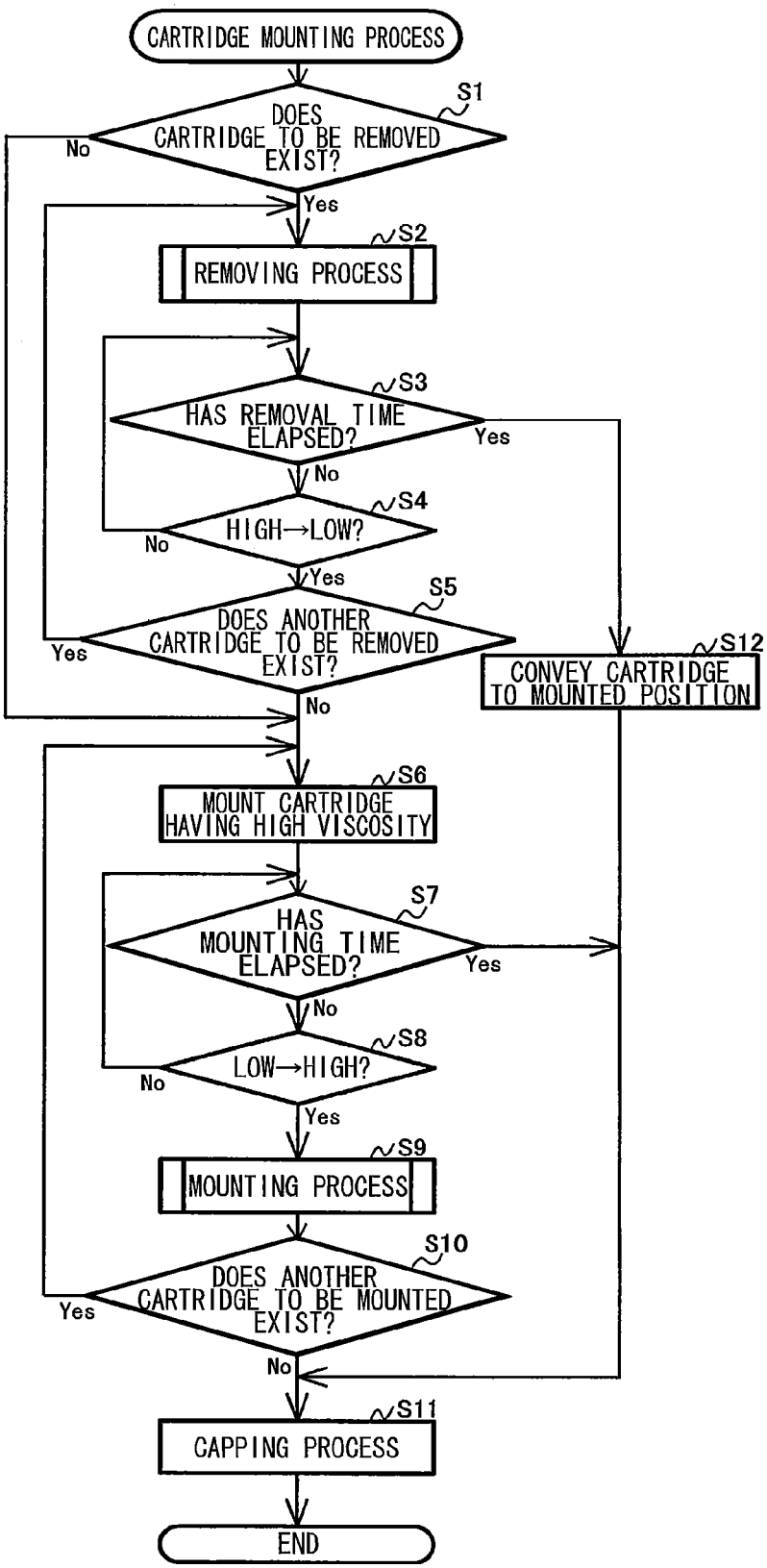
FIG. 8 is a flowchart illustrating steps of a cartridge mounting process according to the embodiment of the invention
Figure 9B:
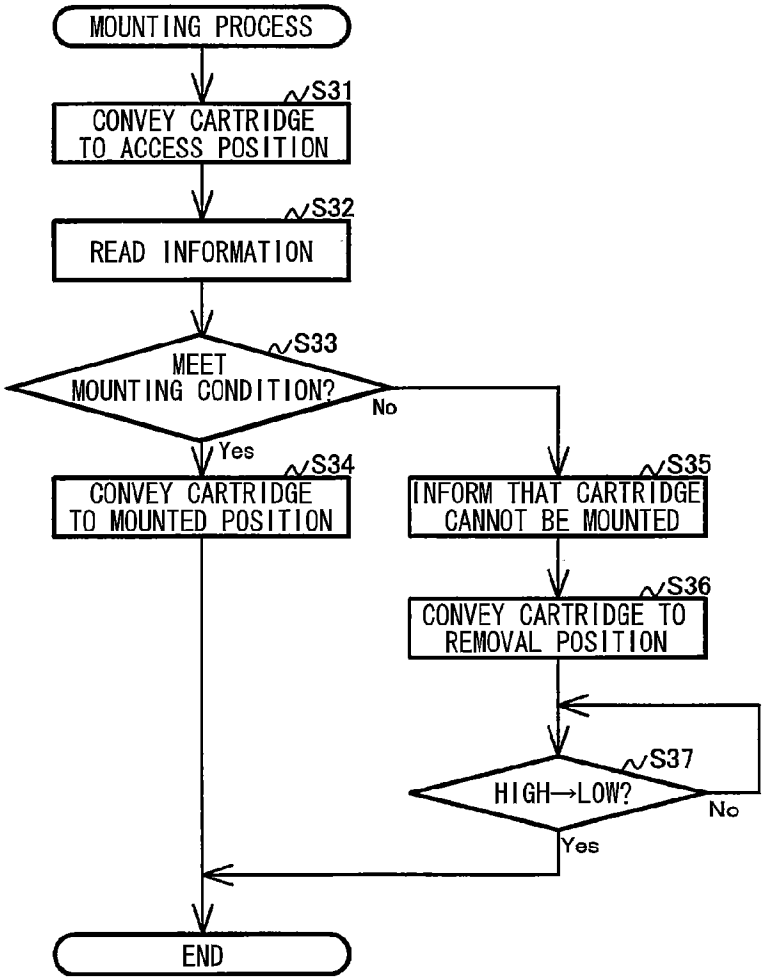
FIG. 9B is a flowchart illustrating steps of a mounting process according to the embodiment of the invention.
Figure 9A:
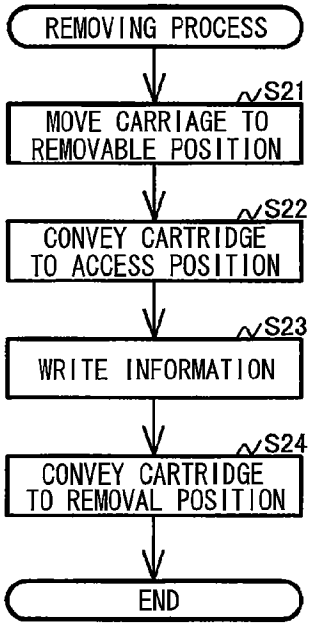
FIG. 9A is a flowchart illustrating steps of a removing process according to the embodiment of the invention.

For example, if the controller 130 receives a replacement command for replacing the cartridges 90A and 90B from the user through the operation unit 29, the controller 130 starts the cartridge mounting process shown in FIG. 8. Each of the steps shown in FIGS. 8 to 9B may be performed by the CPU 131 reading the program from the ROM 132 or may be performed by a hardware circuit such as an ASIC 135 or a field-programmable gate array (FPGA) or the like.

First, the controller 130 determines whether a cartridge to be removed exists or not (S1). That is, the controller 130 determines whether the cartridges 90A and 90B are mounted on the mounting units 32 and 33. If the high level signals are output from the mounting sensors 32C corresponding to the cartridges 90A and 90B, that is, the cartridges 90A and 90B are mounted on the mounting units 32 and 33 (S1: Yes), the controller 130 performs a removing process (S2). The removing process is an example of a second process. The removing process will be described in detail with reference to FIG. 9A.

The controller 130 moves the carriage 30 to the removable position by driving the carriage motor 102 (S21). More specifically, the controller 130 moves the carriage 30 to the first removable position where the cartridge 90A mounted on the mounting unit 32 faces the conveying mechanism 50 in the front-rear direction 8. At this time, the controller 130 can recognize that the carriage 30 reaches the removable position by counting the pulse signals output from the carriage sensor 36.

Next, the controller 130 conveys the cartridge 90A mounted on the mounting unit 32 to the access position (S22). More specifically, the controller 130 supplies the second current to the electromagnet 32D, conveying the cartridge 90A from the mounted position shown in FIG. 6D to the intermediate position shown in FIG. 6C. Next, the controller 130 rotates the pinion gear 51 in the second direction, conveying the cartridge 90A from the intermediate position shown in FIG. 6C to the access position shown in FIG. 6B.

Next, the controller 130 writes the ejection amount information or the ink remaining amount information of the cartridge 90A as the cartridge information in the IC chip 93A through the contact 52 (S23). In addition, in step S23, if the ejection amount associated with the cartridge 90A reaches the threshold ejection amount, the controller 130 writes the used-up information in the IC chip 93A through the contact 52. Alternatively, if the ink remaining amount in the cartridge 90A is less than the threshold remaining amount, the controller 130 writes the used-up information in the IC chip 93A.

The used-up information may be a flag indicating that the ejection amount of the ink reaches the threshold ejection amount or may be the ejection amount information itself. In the latter case, for example, in the step S33 described later, the controller 130 may recognize as the used-up information the ejection amount information indicating that the ejection amount is more than or equal to the threshold ejection amount. Alternatively, the used-up information may be a flag indicating that the ink remaining amount in the cartridge 90A is less than the threshold remaining amount or may be the ink remaining amount information itself. In the latter case, for example, in the step S33 described later, the controller 130 may recognize as the used-up information the ink remaining amount information indicating that the ink remaining amount is less than the threshold remaining amount.

When the recording head 31 ejects the ink, the controller 130 may perform a counting process to count the ejection amount (or the number of ejection times) of the corresponding ink for each of the cartridges 90A to 90D and store the counted value as the ejection amount information in the EEPROM 134. Alternatively, the controller 130 may store the ink remaining amount estimated from the ejection amount as the ink remaining amount information in the EEPROM 134. This counting process is an example of a fourth process. In step S23, the controller 130 resets the ejection amount information or the ink remaining amount information of the cartridge 90A stored in the EEPROM 134. On the other hand, the controller 130 continuously stores at least the viscosity information of the cartridge 90A in the EEPROM 134.

Next, the controller 130 rotates the pinion gear 51 in the second direction to convey the cartridge 90A to the removal position shown in FIG. 6A (S24), and then the removing process is ended. In step S24, the controller 130 may prompt the user to remove the cartridge 90A at the removal position from the conveying mechanism 50 through the opening 13B. A specific prompting method is not particularly limited. For example, a message or an animation may be displayed on the display unit 28, or a guidance voice may be output from a speaker (not shown).

Returning to FIG. 8, the controller 130 monitors based on the mounting/non-mounting signal output from the mounting sensor 53 whether the cartridge 90A is removed from the conveying mechanism 50 (S4) until a predetermined removal time elapses after the movement of the cartridge 90A to the removal position is finished (S3). If the cartridge 90A is removed from the conveying mechanism 50, that is, if the mounting/non-mounting signal output from the mounting sensor 53 is changed from the high level signal (indicated by "HIGH" in the drawings) to the low level signal (indicated by "LOW" in the drawings) within the removal time (S3: No, S4: Yes), the controller 130 determines whether another cartridge to be removed exists (S5).

In this embodiment, since the cartridge 90B is the other cartridge to be removed (S5: Yes), the controller 130 repeatedly performs the steps (S2 to S4) for removing the cartridge 90B. That is, the controller 130 moves the carriage 30 to the second removable position and conveys the cartridge 90B from the mounted position to the removal position through the access position and the intermediate position.

Next, if the cartridges 90A and 90B to be removed are removed (S5: No), the controller 130 performs a guiding process to prompt the user to mount new cartridges 90A and 90B on the conveying mechanism 50 through the opening 13B (S6). For example, the controller 130 may display on the display unit 28 a message for prompting the mounting of the new cartridges 90A and 90B. The guiding process of step S6 is an example of a third process. In addition, in the embodiment, in step S6, the controller 130 prompts the user to mount the cartridge 90A prior to the cartridge 90B, the cartridge 90A having a higher viscosity indicated by the viscosity information stored in the EEPROM 134 than that of the cartridge 90B.

Next, the controller 130 monitors based on the mounting/non-mounting signal output from the mounting sensor 53 whether the cartridge 90A is mounted on the conveying mechanism 50 (S8) until a predetermined mounting time elapses after the guiding process of S6 is performed, i.e., after prompting the mounting of the cartridge 90A (S7). If the user mounts the cartridge 90A in the conveying mechanism 50, that is, if the mounting/non-mounting signal output from the mounting sensor 53 is changed from the low level signal to the high level signal within the mounting time (S7: No, S8: Yes), the controller 130 performs a mounting process (S9). The mounting process is an example of a first process. The mounting process will be described in detail with reference to FIG. 9B.

The position of the cartridge 90A mounted on the conveying mechanism 50 by the user may not be coincident with the removal position, provided that the pinion gear 51 and the rack gear 95A are engaged with each other. In addition, in the embodiment, the mounting process of FIG. 9B is performed irrespective of whether or not the mounted cartridge 90A has been used. That is, the mounting process shown in FIG. 9B is performed even if the cartridge 90A mounted in step S8 is a unused (new) product, a used product (where a portion of the ink in the accommodation chamber 91A has been already ejected), or the cartridge 90A removed in step S4.

First, the controller 130 rotates the pinion gear 51 in the first direction to convey the cartridge 90A mounted on the conveying mechanism 50 by the user to the access position shown in FIG. 6B (S31). Next, the controller 130 reads the cartridge information including the type information, the expiration information, the ejection amount information, the ink remaining amount information, and the used-up information, or any combination thereof, from the IC chip 93A through the contact 52 (S32). Next, the controller 130 determines whether the cartridge 90A meets a mounting condition (S33). The mounting condition is not particularly limited, but for example, the following conditions may be employed.

As a first example, if the type information of the cartridge 90A is different from the type information of the cartridge 90C and the type information of the cartridge 90D which have already been mounted on the mounting units 34 and 35, the controller 130 determines that the mounting condition is met. In this case, the controller 130 may compare the type information read in step S32 with the type information stored in the EEPROM 134.

In this case, since the type information of the cartridge 90A currently positioned at the access position is different from the type information of the cartridges 90C and the type information of the cartridge 90D mounted on the mounting units 34 and 35, the mounting condition is met (S33: Yes). On the other hand, assuming that the cartridge 90C is mounted on the conveying mechanism 50 instead of the cartridge 90A in S8, the type information of the cartridge 90C positioned at the access position is the same as the type information of the cartridge 90C mounted on the mounting unit 34. In this assumed case, the mounting condition is not met (S33: No).

As a second example, if the use-by date identified by the expiration information read in step S32 has not passed, i.e., the current date acquired from an internal clock precedes the expiration date, the controller 130 determines that the mounting condition is met. In addition, in a case where the expiration information indicates the production date of the cartridge 90A, the controller 130 may identify the use-by date by adding a predetermined period of time to the production date, and compare the identified use-by date with the current date. In addition, in a case where the expiration information indicates the use-by date itself, the controller 130 may compare the use-by date with the current date.

As a third example, if the used-up information is not stored in the IC chip 93A, the controller 130 determines that the mounting condition is met. In addition, in a case where the used-up information is a flag, the controller 130 determines whether the flag is stored in the IC chip 93A. In addition, in a case where the used-up information is the ejection amount information, the controller 130 compares the ejection amount specified by the ejection amount information with the threshold ejection amount. In a case where the used-up information is the ink remaining amount information, the controller 130 compares the ink remaining amount specified by the ink remaining amount information with the corresponding threshold remaining amount.

In addition, if the mounting condition is met in step S33, the controller 130 stores the ejection amount information or the ink remaining amount information read in step S32 in the EEPROM 134. If the cartridge 90A is a new product, the ejection amount specified by the ejection amount information is zero. If the cartridge 90A is a new product, the ink remaining amount specified by the ink remaining amount information is the initial amount of the ink accommodated in the cartridge 90A. After that, when the ink is ejected from the cartridge 90A through the recording head 31, the controller 130 counts the ejection amount and updates the ejection amount information or the ink remaining amount information stored in the EEPROM 134. The controller 130 may store both the ejection amount information and the ink remaining amount information read in step S32 in the EEPROM 134. In this case, the controller 130 may update the ejection amount information and the ink remaining amount information stored in the EEPROM 134.

Next, if the mounting condition is met (S33: Yes), the controller 130 drives the carriage motor 102 to move the carriage 30 to the first mounted position, and controls the conveying mechanism 50 to convey the cartridge 90A to the mounted position shown in FIG. 6D (S34). Then, the mounting process is ended. More specifically, the controller 130 rotates the pinion gear 51 in the first direction, moving the cartridge 90A from the removal position shown in FIG. 6A to the intermediate position shown in FIG. 6C. Subsequently, the controller 130 supplies the first current to the electromagnet 32D, conveying the cartridge 90A from the intermediate position shown in FIG. 6C to the mounted position shown in FIG. 6D.

On the other hand, if the mounting condition is not met (S33: No), the controller 130 informs that the cartridge 90A cannot be mounted (S35). The controller 130 conveys the cartridge 90A to the removal position shown in FIG. 6A (S36). If the cartridge 90A is removed from the conveying mechanism 50, that is, if the mounting/non-mounting signal output from the mounting sensor 53 is changed from the high level signal to the low level signal (S37: Yes), the mounting process is ended.

Even if the cartridge 90B is wrongly mounted on the conveying mechanism 50 contrary to the guidance that the cartridge 90A having high viscosity ink needs to be mounted before the other cartridge in step S6, the controller 130 may move the carriage 30 to the second removable position and convey the cartridge 90B to the mounted position (S34), provided that the mounting condition is met (S33: Yes). That is, the mounting condition determined in step S33 may be unrelated to whether the cartridge 90A is mounted in accordance with the guidance that the cartridge 90A needs to be mounted before the other cartridge.

Returning to FIG. 8, the controller 130 determines whether another cartridge to be mounted exists (S10). In the embodiment, since the cartridge 90B is as the other cartridge to be mounted (S10: Yes), the controller 130 performs the steps (S6 to S9) again to mount the cartridge 90B. That is, if the mounting condition is met in the mounting process (S33: Yes), the controller 130 moves the carriage 30 to the second removable position and conveys the cartridge 90B to the mounted position (S34). If the cartridges 90A and 90B are respectively mounted (S10: No) on the mounting units 32 and 33, the controller 130 moves the carriage 30 to the capping position and moves the cap 41 to the covering position by driving the carriage motor 102 and the elevating motor 103 (S11). The process of step S11 is an example of a capping process.

If the mounting/non-mounting signal output from the mounting sensor 53 in step S7 is not changed from the low level signal to the high level signal within the mounting time, i.e., the cartridge 90A is not mounted on the conveying mechanism 50 within the mounting time (S7: Yes), the controller 130 performs the capping process in step S11. If the mounting/non-mounting signal output from the mounting sensor 53 in step S3 is not changed from the high level signal to the low level signal within the removal time, i.e., the cartridge 90A is not removed from the conveying mechanism 50 within the removal time (S3: Yes), the controller 130 conveys the cartridge 90A to the mounted position (S12) and performs the capping process in step S11.

If the cartridges 90A and 90B are not mounted on the mounting units 32 and 33 in step S1 (S1: No), the controller 130 skips the steps S2 to S5. A case where the cartridges 90A and 90B are not mounted on the mounting units 32 and 33 in step S1 may correspond to, for example, a case where the cartridges 90A and 90B are not mounted on the mounting units 32 and 33 within the mounting time and the capping process is performed (S7: Yes→S11), and after that, the cartridge mounting process is performed again. The case where the cartridges 90A and 90B are not mounted on the mounting units 32 and 33 in step S1 may also correspond to a case where the inkjet recording device 100 is shipped in the state that the cartridges 90A to 90D are not mounted on the carriage 30, and after the shipment of the inkjet recording device 100, the process of mounting the cartridges 90A to 90D is initially performed.

[Operational Advantages of the Embodiment]

According to the above-described embodiment, the mounting condition is determined before the cartridges 90A to 90D is conveyed to the mounted position, thereby preventing the mounting of the cartridges 90A to 90D from being mounted on the mounting units 32 to 35 when the prescribed condition is not met. As a result, only the cartridges 90A to 90D appropriate for the mounting are mounted at the appropriate positions of the carriage 30. That is, the mounting condition is determined before the cartridges 90A to 90D have been mounted on the mounting units 32 to 35, avoiding completely mounting the cartridges 90A to 90D to the inappropriate mounting units 32 to 35.

For example, if the ink needle 32B corresponding to the cartridge 90A is inserted into one of the cartridges 90B to 90D accommodating the inks having a color different from that of the cartridge 90A, different color inks may be mixed in the needle 32B or the recording head 31. However, according to the embodiment, such a likelihood can be reduced. In addition, if the cartridges 90A to 90D whose use-by date have already elapsed are mounted on the mounting units 32 to 35, the ink having a poor quality may be ejected from the recording head 31. However, according to the embodiment, such a likelihood can be reduced. In addition, if the cartridges 90A to 90D having low (or no) ink remaining amount are mounted on the mounting units 32 to 35 again, malfunction may occur in the inkjet recording device 100. However, according to the embodiment, such a likelihood can be reduced.

According to the above-described embodiment, if the cartridges 90A to 90D mounted on the conveying mechanism 50 do not meet the mounting condition, the cartridges 90A to 90D are not conveyed to the mounted position. Therefore, the time taken to the error process (for example, steps S35 to S37 in FIG. 9B) upon the inappropriate mounting of the cartridges 90A to 90D in the conveying mechanism 50 can be shortened. That is, in the embodiment, if the cartridges 90A to 90D do not meet the mounting condition, the cartridges 90A to 90D are conveyed not to the mounted position but to the access position. The distance between the removal position and the access position is smaller than the distance between the removal position and the mounted position. Consequently, the conveyance time of the cartridges 90A to 90D can be saved, thereby reducing the time taken to the error process. In addition, since all the cartridges 90A to 90D are conveyed by the common conveying mechanism 50, the number of parts (for example, the pinion gear 51 or the contact 52) can be reduced.

According to the embodiment, a likelihood can be reduced that the ink is dried when the carriage 30 remains at the removable position for a long time. For example, if the cartridge 90A is not removed from the conveying mechanism 50 within the removal time (S3: Yes), the capping process is performed (S11), thereby reducing ejecting defect due to clogging by the dried ink in the nozzles 31A exposed from the nozzle surface 31B. For another example, if the cartridge 90A is not mounted on the conveying unit 50 within the mounting time (S7: Yes), the capping process is performed (S11), thereby reducing the ejecting defect due to the clogging by the dried ink in the nozzles 31A. Further, the controller 130 repeatedly performs the steps S6-S10 until all of the cartridges to be mounted has been mounted (S10: Yes). As a result, all of the cartridges 90A to 90D are respectively mounted on the mounting units 32 to 35, thereby avoiding exposing the ink needle 32B and reducing the ejecting defect due to the clogging by the dried ink in the ink needle 32B in the mounting units 32 to 35.

According to the embodiment, since the controller 130 prompts a user to mount the cartridges 90A to 90D in the order from the highest viscosity of the ink accommodated in the cartridges 90A to 90D (S6), the clogging in the recording head 31 and the ink needle 32B by the dried ink can be effectively reduced. If the viscosity of the ink accommodated in each of the cartridges 90A to 90D to be mounted is the same, for example, the mounting of the cartridges may be guided in the order of the removal. According to the above-described embodiment, since the controller 130 informs that the cartridges mounted on the conveying mechanism 50 cannot be mounted (S35), the user can recognize that the cartridges 90A to 90D cannot be used.

In addition, in the cartridge mounting process according to the above-described embodiment, if a plurality of the cartridges 90A and 90B are removed and new cartridges 90A and 90B are mounted, all of the cartridges 90A and 90B are removed before the new cartridges 90A and 90B are mounted. However, the invention is not limited to the embodiment. For example, the removing and mounting processes may be performed in the order of removing the cartridge 90A, mounting the new cartridge 90A, removing the cartridge 90B, and mounting the new cartridge 90B.

In addition, the start of the cartridge mounting process is not limited to a case where the replacement command is received from a user. For example, if the ink remaining amount accommodated in the cartridges 90A to 90D is less than the threshold remaining amount, the controller 130 may automatically start performing the cartridge mounting process. Since the replacement of the cartridges 90A to 90D having low (or no) ink remaining amount is prompted, the operation rate of the inkjet recording device 100 can be improved. For another example, if the cartridges 90A to 90D are not mounted on the mounting units 32 to 35 when the inkjet recording device 100 is powered on, the controller 130 may automatically start the cartridge mounting process.

In addition, the number of cartridges 90A to 90D mounted on the carriage 30 is not limited to four, but one or plural cartridges may be employed. In addition, the liquid accommodated in the cartridges 90A to 90D is not limited to ink, but a pre-treatment liquid ejected on the recording sheet 5 prior to the ink during printing operation may be employed as a liquid.

In addition, a plurality of conveying mechanisms 50 and a plurality of the openings 13B may be arranged in the left-right direction 9. For example, the plurality of openings 13B may include a first opening 13B and a second opening 13B. The cartridge 90A may be a large-capacity cartridge accommodating a black ink, and the cartridges 90B to 90D may be small-capacity cartridges (that is, having a volume of the accommodation chamber smaller than that of the cartridge 90A) accommodating yellow ink, magenta ink, and cyan ink, respectively. The plurality of the conveying mechanisms may include a first conveying mechanism 50 configured to replace the large-capacity cartridge 90A through the first opening 13B and a second conveying mechanism 50 configured to replace the small-capacity cartridges 90B to 90D through the second opening 13B.

In addition, if the cross-sectional shape of the cartridge 90A is different from the cross-sectional shapes of the cartridges 90B to 90D, the cross-sectional shape of the first opening 13B and the cross-sectional shape of the second opening 13B may be configured to correspond to the cross-sectional shape of the cartridge 90A and the cross-sectional shapes of the cartridges 90B to 90D, respectively. In addition, the first conveying mechanism 50 and the first opening 13B may be arranged at one side of the casing 10 in the left-right direction 9 (for example, the left side of the casing 10 with respect to the center of the casing 10), and the second conveying mechanism 50 and the second opening 13B may be arranged at the other side of the casing 10 in the left-right direction 9 (for example, the right side of the casing 10 with respect to the center of the casing 10).

In addition, the recording head 31 needs not to be fixed to the carriage 30, but the recording head 31 may be integrally provided on each of the cartridges 90A to 90D. When the cartridges 90 A to 90D are mounted on the carriage 30, the recording head provided in each of the cartridges 90A to 90D is exposed from an opening formed on the lower surface of the carriage 30. That is, the recording head is mounted on the carriage 30 in a state where the cartridges 90A to 90D are mounted on the carriage 30.

In addition, the position of the opening 13B is not limited to the front wall 13. For example, the opening 13B may be formed in a slanted wall surface formed between the top wall 11 and the front wall 13. That is, the opening 13B through which the cartridges 90A to 90D can pass according to the embodiment may be formed in an interface surface, e.g., the front wall 13, provided with an user interface such as the display unit 28 or the operation unit 29 and intersecting the horizontal plane in which the nozzle surface 31B extends or in a surface of the casing 10 which intersects the horizontal plane in which the nozzle surface 31B extends and is positioned adjacent to the interface surface, thereby facilitating the removal and mounting of the cartridges 90A to 90D with respect to the conveying mechanism 50 through the opening 13B.

In addition, the access unit and the first storage are not limited to the contact 52 and the IC chip 93A of the embodiment. For example, the access unit and the first storage may transmit information therebetween by a near field communication (NFC) as a wireless communication. For another example, the access unit and the first storage may be a combination of a thermal head and a thermal sheet. For still another example, the access unit and the first storage may be a combination of an optical sensor and an optical pattern including portions for blocking the light output from the optical sensor and portions for allowing the light to pass therethrough. That is, first storage may not necessarily be rewritable storage.

In addition, the electromagnet 32D and the magnet 94A are configured to convey the cartridge 90A between the intermediate position shown in FIG. 6C and the mounted position shown in FIG. 6D. However, the assisting unit is not limited to this configuration. For example, the conveying mechanism 50 may further include a mounting mechanism configured to convey the cartridge 90A between the intermediate position shown in FIG. 6C and the mounted position shown in FIG. 6D by moving into and out of the carriage 30 while holding the cartridge 90A.

Alternatively, a modified example of the conveying mechanism shown in FIGS. 10A to 10D may be employed. The parts and components as those of the above-described embodiment are depicted as the same reference numerals to avoid duplicate description, and the detailed description thereof will be omitted. The different configurations will be mainly described.

Figure 10A:
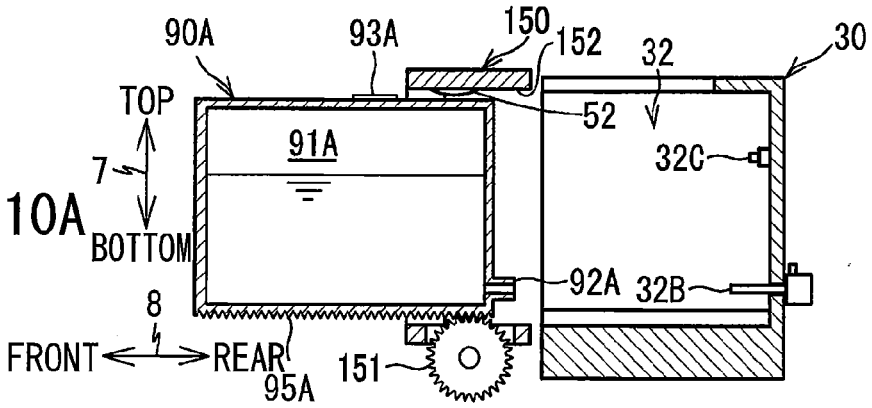
FIG. 10A is a cross-sectional view showing a carriage, a cartridge, and a conveying mechanism wherein the cartridge is positioned at a removal position according to a modification of the invention.
Figure 10B:
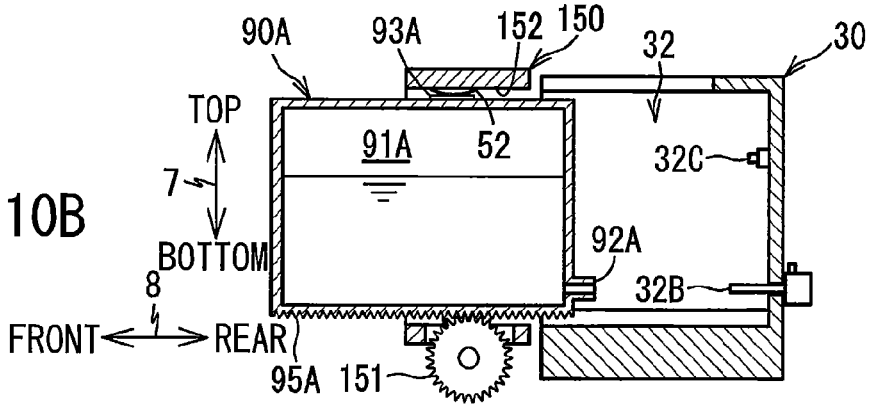
FIG. 10B is a cross-sectional view showing the carriage, the cartridge, and the conveying mechanism wherein the cartridge is positioned at an access position according to the modification of the invention.
Figure 10C:
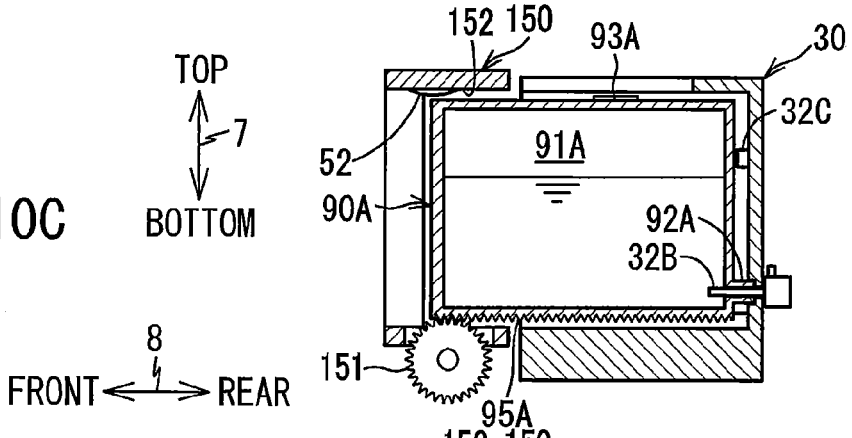
FIG. 10C is a cross-sectional view showing the carriage, the cartridge, and the conveying mechanism wherein the cartridge is positioned at a mounted position and a pinion gear is positioned at an engagement position according to the modification of the invention.

As shown in FIGS. 10A to 10C, a conveying mechanism 150 according to the modified example is configured to rotate a pinion gear 151 in the first direction and the second direction when the pinion gear 151 is engaged with the rack gear 95A, thereby conveying the cartridge 90A between the removal position and the mounted position. The conveying mechanism 150 has a pair of side walls, each formed with an opening 152 penetrating therethrough in the left-right direction 9. The openings 152 correspond to the rear portion of the cartridge 90A at the mounted position, i.e., the openings 152 are overlapped with at least part of the cartridge 90A at the mounted position as viewed from the left-right direction 9, allowing the cartridge 90A to move in the left-right direction 9.

Figure 10D:
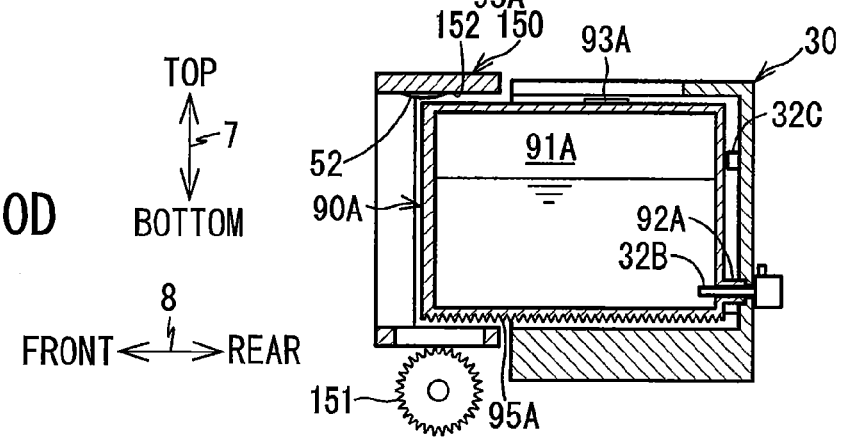
FIG. 10D is a cross-sectional view showing the carriage, the cartridge, and the conveying mechanism wherein the cartridge is positioned at the mounted position and the pinion gear is positioned at a retracted position according to the modification of the invention.

The pinion gear 151 is configured to receive the driving force from the elevating motor 103. Upon receiving the driving force, the pinion gear 151 can move (rise and fall) between an engagement position where the pinion gear 151 is engaged with the rack gear 95A (FIGS. 10A to 10C) and a retracted position where the pinion gear 151 is vertically separated from the rack gear 95A (FIG. 10D). In the example of FIGS. 10A to 10D, the engagement position and the retracted position are separated from each other in the top-bottom direction 7 (that is, the direction intersecting the front-rear direction 8 which is the conveying direction).

When the cartridge 90A is mounted on the carriage 30, the conveying mechanism 150 moves the pinion gear 151 in the first direction to convey the cartridge 90A mounted on the conveying mechanism 50 by the user to the mounted position through the access position (FIGS. 10A to 10C). Subsequently, the conveying mechanism 150 moves the pinion gear 151 downward from the engagement position to the retracted position (FIGS. 10C and 10D). With the pinion gear 151 positioned at the retracted position, the carriage 30 can be moved from the removable position in the left-right direction 9 without interfering with the pinion gear 151 and other components of the conveying mechanism 150.

On the other hand, when the cartridge 90A is removed from the carriage 30, the conveying mechanism 150 moves the pinion gear 151 upward from the retracted position to the engagement position (FIGS. 10D and 10C). Subsequently, the conveying mechanism 150 rotates the pinion gear 151 in the second direction to convey the cartridge 90A from the mounted position to the removal position through the access position (FIGS. 10C to 10A).

While the invention has been described in detail with reference to the embodiments thereof, it would be apparent to those skilled in the art that various changes and modifications may be made therein without departing from the spirit of the invention.

What is claimed is:

1. A liquid ejecting device comprising:

a casing formed with an opening;

a carriage configured to be movable in a main-scanning direction in the casing and be positionable at a first position;

a cartridge comprising an accommodation chamber accommodating liquid therein, and a first storage configured to store cartridge information, the cartridge being removably mountable on the carriage through the opening when the carriage, with the cartridge mounted thereon, is at the first position;

an ejection unit configured to eject the liquid accommodated in the accommodation chamber, the ejection unit being mounted on the carriage in a state where the cartridge is mounted on the carriage;

a conveying mechanism configured to convey the cartridge between a second position and a third position, wherein the cartridge is mounted on the carriage and the liquid accommodated in the accommodation chamber is ejectable from the ejection unit when the cartridge is in the second position, wherein at least part of the cartridge is exposed and positioned outside the casing through the opening when the cartridge is in the third position, the conveying mechanism being positioned between the opening and the carriage positioned at the first position;

an access unit configured to access the first storage to read the cartridge information when the cartridge is at a position different from the second position; and a controller configured to perform a first process to:

control the access unit to read the cartridge information from the first storage;

determine whether the cartridge information meets a prescribed condition; and control the conveying mechanism to convey the cartridge to the second position, if the cartridge information meets the prescribed condition.

2. The liquid ejecting device according to claim 1, wherein the cartridge further comprises a liquid supplying portion configured to supply the liquid accommodated in the accommodation chamber to an outside of the cartridge, wherein the cartridge information stored in the first storage comprises type information indicating a type of the liquid accommodated in the accommodation chamber, wherein the carriage comprises the ejection unit and a liquid introducing portion configured to connect the ejection unit with the liquid supplying portion of the cartridge positioned at the second position, the carriage being configured to receive a plurality of cartridges, wherein the liquid ejecting device further comprises second storage configured to store the type information of each of the plurality of cartridges mounted on the carriage, the type information being read by the access unit, and wherein the controller is configured to determine that the cartridge information meets the prescribed condition in the first process if the type information read by the access unit in the first process is different from the type information stored in the second storage.

3. The liquid ejecting device according to claim 1, wherein the cartridge information stored in the first storage comprises expiration information to be used for identifying a use-by date of the cartridge, and wherein the controller determines that the cartridge information meets the prescribed condition in the first process if a current date precedes the use-by date identified by the expiration information.

4. The liquid ejecting device according to claim 1, wherein the controller is further configured to inform that the cartridge cannot be mounted on the carriage if the cartridge information read by the access unit does not meet the prescribed condition.

5. The liquid ejecting device according to claim 1, wherein the controller is further configured to:

perform a second process to move the carriage to the first position and to convey the cartridge to the third position; and perform a third process to prompt a user to mount another cartridge on the conveying mechanism, wherein the controller performs the first process for the other cartridge after the third process is performed.

6. The liquid ejecting device according to claim 5, wherein the controller is further configured to perform a fourth process to count an ejection amount of the liquid which has been ejected from the ejection unit, and wherein the controller performs the second process if the ejection amount counted in the fourth process reaches a threshold value.

7. The liquid ejecting device according to claim 6, wherein the first storage is rewritable storage, wherein the controller is further configured to control the access unit to write in the first storage, as the cartridge information, used-up information indicating that the ejection amount reached the threshold value, and wherein the controller is further configured to determine that the cartridge information meets the prescribed condition in the first process if the cartridge information read by the access unit does not comprise the used-up information.

8. The liquid ejecting device according to claim 5, wherein the cartridge information stored in the first storage comprises viscosity information indicating a viscosity of the liquid accommodated in the accommodation chamber, wherein the carriage is configured to receive a plurality of cartridges, wherein the plurality of cartridges comprises a first cartridge which accommodates liquid having a first viscosity indicated by the viscosity information stored in the first storage of the first cartridge and a second cartridge which accommodates liquid having a second viscosity indicated by the viscosity information stored in the first storage of the second cartridge, the first viscosity being higher than the second viscosity, wherein the liquid ejecting device further comprises mounting sensors, each configured to output a signal indicating whether or not a corresponding one of the plurality of cartridges is mounted on the carriage, and wherein the controller is configured to prompt a user to mount the first cartridge prior to the second cartridge in the third process when the controller determines that at least the first cartridge and the second cartridge are not mounted on the carriage based on the signals output from the mounting sensors.

9. The liquid ejecting device according to claim 5, wherein the ejection unit comprises a plurality of nozzles configured to eject the liquid and having tip ends, the nozzles being exposed from the carriage, the ejection unit defining a nozzle surface provided with the tip ends of the nozzles, wherein the liquid ejecting device further comprises:

a cap facing the carriage at a fourth position different from the first position, the cap being configured to move between a fifth position at which the cap covers the nozzle surface and a sixth position at which the cap is separated from the nozzle surface; and a mounting sensor configured to output a signal indicating whether or not the cartridge is mounted on the conveying mechanism, and wherein the controller is further configured to move the carriage to the fourth position and move the cap to the fifth position, if the signal indicating that the cartridge is mounted on the conveying mechanism is not output from the mounting sensor within a mounting time after the third process is performed.

10. The liquid ejecting device according to claim 5, further comprising a mounting sensor configured to output a signal indicating whether or not the cartridge is mounted on the conveying mechanism, wherein the controller is configured to control the conveying mechanism to convey the cartridge from the third position to the second position in the second process, if the signal indicating that the cartridge is removed from the conveying mechanism is not output from the mounting sensor within a removal time.

11. The liquid ejecting device according to claim 5, wherein the controller is further configured to estimate an amount of remaining liquid accommodated in the accommodation chamber of the cartridge, wherein the controller performs the second process if the estimated amount of liquid remaining is less than a threshold remaining amount.

12. The liquid ejecting device according to claim 11, wherein the first storage is rewritable storage, wherein the controller is further configured to control the access unit to write in the first storage, as the cartridge information, used-up information indicating that the amount of liquid remaining is less than the threshold remaining amount, and wherein the controller is further configured to determine that the cartridge information meets the prescribed condition in the first process if the cartridge information read by the access unit does not comprise the used-up information.

13. The liquid ejecting device according to claim 1, further comprising a user interface configured to output information to a user and receive information from the user, wherein the ejection unit comprises a plurality of nozzles configured to eject the liquid and having tip ends, the nozzles being exposed from the carriage, the ejection unit defining a nozzle surface provided with the tip ends of the nozzles, the nozzle surface extending in a plane, wherein the casing defines an interface surface provided with the user interface and intersecting the plane, and wherein the opening is formed in the interface surface or in a surface of the casing which intersects the plane and is positioned adjacent to the interface surface.

14. The liquid ejecting device according to claim 1, wherein the conveying mechanism is configured to convey the cartridge from the second position to the third position through an intermediate position, and wherein the liquid ejecting device further comprises an assisting unit configured to convey the cartridge from the intermediate position to the second position.

15. The liquid ejecting device according to claim 1, wherein the conveying mechanism is formed with an opening overlapped with at least a part of the cartridge at the second position as viewed from the main-scanning direction, the opening allowing the at least a part of the cartridge to pass through the opening when the carriage moves in the main-scanning direction.

16. The liquid ejecting device according to claim 15, wherein the conveying mechanism is configured to convey the cartridge from the second position to the third position through an intermediate position, wherein the conveying mechanism comprises an engaging member configured to engage the cartridge, and wherein the engaging member is configured to be engaged with the cartridge at the third position and the intermediate position, and the engaging member is disengaged from the cartridge at the second position.

* * * * *